United States Patent [19]

Jones

[11] Patent Number: 5,054,139

[45] Date of Patent: Oct. 8, 1991

[54] BED WITH CONCEALED ENTERTAINMENT CENTER

[76] Inventor: Thomas L. Jones, 3 Indian Pl., Asheville, N.C. 28805

[21] Appl. No.: 419,555

[22] Filed: Oct. 10, 1989

[51] Int. Cl.[5] ..... A47C 31/00

[52] U.S. Cl. ..... 5/2.1; 5/508; 5/414; 312/7.2

[58] Field of Search ..... 5/1, 2 R, 508, 414, 5/503, 507; 248/917; 312/7.2

[56] References Cited

U.S. PATENT DOCUMENTS

| | | | |
|---|---|---|---|
| 3,608,101 | 6/1969 | Castro | 5/2 R |
| 4,395,785 | 8/1983 | Huh | 5/2 R |
| 4,505,078 | 3/1985 | Huh | 5/2 R |
| 4,594,817 | 6/1986 | McLaren | 5/2 R |
| 4,607,401 | 8/1986 | Sisson | 5/414 |
| 4,829,725 | 5/1989 | Gustaveson | 312/7.2 |
| 4,903,353 | 2/1990 | Park | 5/2 R |

*Primary Examiner*—Gary L. Smith
*Assistant Examiner*—F. Saether
*Attorney, Agent, or Firm*—Pollock, VandeSande & Priddy

[57] ABSTRACT

A combination of a bed with a TV set comprises a bed frame structure, a supporting structure provided within the frame structure for supporting a TV set thereon, a mechanism for positioning of the TV set for unobstructed viewing by a person while reclining on the bed, and a structure for concealing the TV set within the frame structure of the bed when the TV set is not in use.

11 Claims, 4 Drawing Sheets

BED WITH CONCEALED ENTERTAINMENT CENTER

FIELD OF THE INVENTION

The present invention relates to a bed combined with an entertainment center, and a television set, which can be concealed within a structure of the bed when not in use, or positioned in such a way that the TV set may be viewed without obstruction while a person is reclining on a bed.

BACKGROUND ART

It has been known to provide various pieces of furniture, including beds, with entertainment centers which have a television or radio set that can be concealed while not being viewed by a person. One example of an integrated sofa-bed and television unit is disclosed in U.S. Pat. No. 3,608,101 to Castro et al in which a retractable television set is mounted in a drawer which slides in and out of a cabinet. The cabinet is attached to one end of a sofa bed, and the drawer can be pulled out towards the front of the sofa. The television is swivel-mounted so as to be viewable either by persons sitting on a sofa or by a person lying on a bed.

It has also been known, for example, from U.S. Pat. No. 4,706,401 to Sisson to provide a bed canopy with a television set or other visual device. The television set is mounted on the rear side of the footboard structure and projects its video image through a footboard mirrored panel to the observers within the canopy.

Neither of the above prior art suggestions provides a simple and aesthetically pleasing structure of a bed and TV set combination, wherein the television can be watched by one or more persons reclining on the bed in a convenient and comfortable manner without viewing obstruction.

SUMMARY OF THE INVENTION

It is an object of the present invention to provide a combination of a bed with a TV set, or other visual device, in which means for supporting a TV set is housed in the bed structure, such that the television set may be concealed when the television is not being used, and wherein the supporting means may be positioned for convenient and unobstructed viewing of the television set by one or more persons reclining on the bed.

It is another object of the present invention to provide a simple and aesthetically pleasing structure of a bed with a TV set which is concealed within the bed structure when not in use and is easily operable to a position allowing for convenient and unobstructed viewing of the TV.

In one embodiment, the means for supporting the TV set can be positioned within the footboard cabinet of the bed structure. In another embodiment, the TV set can be concealed in the canopy of a canopy bed and mounted to a motorized lift mechanism which retracts or extends the TV set for viewing. In addition, means may be provided to control the specific angle of the TV screen for a convenient viewing by a person reclining on a bed. In one preferred embodiment of a canopy bed, a portion of the canopy's bottom wall lifts upwardly as the TV set supporting means lowers. Such arrangement can significantly reduce the distance by which the TV has to be lowered for the TV screen to be visible. In the preferred embodiment, this distance is reduced by about one-half. Also, the height of the canopy necessary to conceal the mechanism for retracting and extending the television set can be reduced.

The present invention will now be described in more detail with reference being made to one preferred embodiment in conjunction with the drawings, wherein:

BEST AND VARIOUS MODES OF CARRYING OUT THE INVENTION

Figure 3:
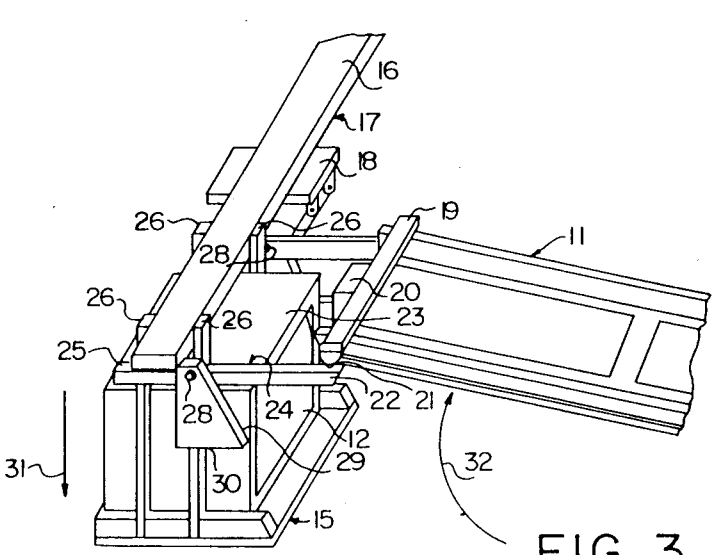
FIG. 3 shows a detailed, partial view of means for movably supporting a TV set.

In the following detailed description of the present invention, the same reference numerals identify the like elements of the structure in each of the several preferred embodiments.

Figure 1:
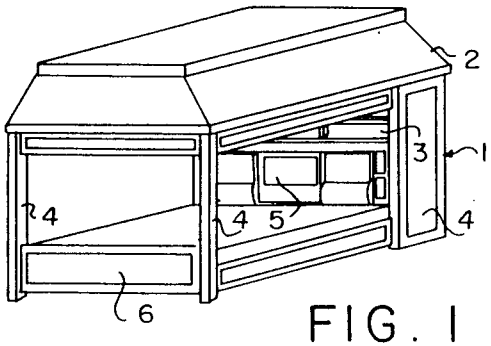
FIG. 1 shows a perspective view of a canopy bed according to the present invention with a canopy structure adapted for concealing a TV set.
Figure 2:
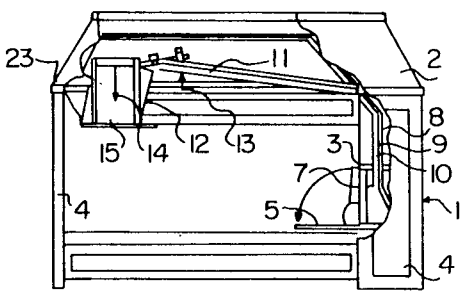
FIG. 2 shows a side view of the canopy bed of FIG. 1 partially cut-away to expose the television set.

FIG. 1 shows a perspective view of a bed 1 with a headboard 3, a footboard 6, and vertical supports 4 which provide support for the canopy 2. A cabinet door 5 is provided on the headboard 3. As best shown in FIG. 2, a television set 23 is supported on a supporting means which comprises a vertically-adjusting cradle. The combination of a canopy bed with a TV set shown in this embodiment allows the viewer lying on the bed 1, convenient access to television viewing and at the same time provides aesthetic storage of the TV set in the canopy 2 when it is not in use. The canopy 2 conceals the television set 23 with vertically-adjusting horizontal panel 11 constituting part of the bottom wall of the canopy 2.

The bed 1, the canopy 2, the headboard 3, the vertical supports 4, the cabinet door 5 on the headboard 3, and the footboard 6, are all constructed of wood, but may be constructed of metal, plastic, a compressed wood product, or other solid, workable material.

FIG. 2 shows the convenience of the viewing relationship between a person reclining on the bed 1 with his head positioned at the headboard 3, and the screen 12 of the television set 23 resting on the cradle base panel 15. Arrow 14 indicates a direction of vertical movement of the cradle base panel 15 while arrow 13 indicates the direction of pivotal movement of at least one horizontal lift panel 11 in order to expose the screen 12 of the television set 23. The cradle base panel 15 moves vertically up and down as indicated by the arrow 14. The horizontal lift panel 11 is positioned in the bottom wall of the canopy 2 and aligned with the cradle base panel 15 when the TV set is not in use and concealed in the canopy. The adjacent edges of panels 11 and 15 mate with each other in a closed position to produce a fine line when viewed from below and to define a bottom wall of the canopy 2.

When the base cradle plate 15 moves down vertically, the right horizontal lift panel 11, (as seen in the direction of the headboard) which is pivotally fixed at the headboard 3 end by a hinge, rotates upwardly with respect to the canopy bottom. As a result of the movement of panel members 11 and 15 in opposite directions, the amount of vertical movement of the TV set can be only one-half the distance necessary to expose the viewing screen 12 of the television 23 that would be necessary if only the cradle base panel 15 were movable in a vertical direction.

The source of the force creating the vertical movement can be provided by a lift which utilizes pressurized fluid or air, or other type of a mechanical lift. Also, another force capable of being applied to two separate points of reference adjusting their relation to each other such as, for example, a magnetic field force can be used to provide vertical movement of the cradle base panel.

FIG. 2 also shows location of a three-way electrical switch 7 which controls a reversing electric motor located in the canopy 2. The reversing electric motor supplies power to the lifting mechanism causing movement of the cradle base plate 15 and of the horizontal lift panel 11. The electricity is supplied to the reversing electric motor and the television 23 via an electrical supply cord 8 which is connected to an electrical supply near the headboard 3. A video cable 9 provides the television 23 with video signals and is connected to an outlet near the headboard 3.

FIG. 3 shows in more detail how the cradle for the television set 23 is constructed and how the movement of the panel members 11 and 15 is accomplished. As is clear from FIG. 3, a television set is attached to the left end of the horizontal beam 17. This structure allows for positioning and convenient viewing of two separate television sets, and different programs, with the sound being separated through the use of the headphones connected to each set. A scissors jack lift plate is attached to the beam 17 and also connected to an electric motor 20. The horizontal lift panel 11 is provided with a horizontal lift bar 19 at its end facing the cradle panel. Rollers 21 are provided at the opposite ends of the bar 19.

As the scissors jack lift plate 18 is lowered by the action of the reversing electric motor 20, the horizontal beam 17, supported by the plate 18 is also lowered, forcing down the end 25 of the lift lever 24 at a point below the beam 17. The lift lever 24 pivots on the fulcrum bolt 28. This causes the other end 22 of the lift lever 24 to raise and engage the roller 21 resting on the horizontal lift bar 19, and push it upwardly, at the same time pivoting the right horizontal lift panel 11 upwardly. The resulting motions cause a separation of the two panel members 11 and 15, exposing the viewing screen 12 of the television 23, which is riding in the cradle. The cradle base panel 15 is connected to the horizontal beam 17 through four vertical supports 26. The lift mechanism is provided on either side of the horizontal lift panel 11 and lifts from both sides. The fulcrum bolt 28 is held into place by a fulcrum rest 29 which is attached to vertical supports on adjacent horizontal panel members. The same arrangement as depicted in FIG. 3 for the left side of the horizontal beam 17 also exists on the right side, but is not shown. An arrow 31 illustrates the vertical type movement of the cradle base panel 15 and the arrow 32 illustrates the pivotal type movement of the right horizontal lift panel 11.

Figure 4:
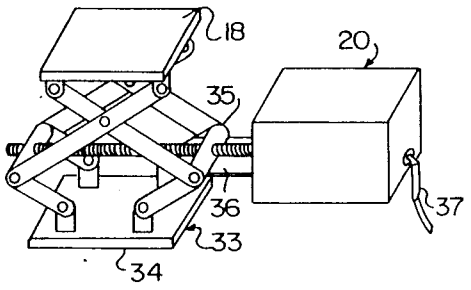
FIG. 4 shows a scissors jack type lift mechanism used in the present invention device.

FIG. 4 is a more detailed illustration of a lift mechanism including the scissors jack 33 connected to the electric motor 20. A flange 36 is attached to a horizontal support 35 of the scissors jack 33 to prevent the motor housing from rotating with respect to the scissors jack 33. The base plate 34 of the scissors jack 33 rests on a support plate attached to construction beams provided in the canopy 2. The scissors jack lift plate 18 effects the movement of the horizontal panels by applying force to the horizontal beam 17 as shown in FIG. 3. In the preferred embodiment, the lifting mechanism includes a scissors jack 33 and an electric motor 20, but other lifting mechanisms which provide a similar action would be suitable. The amount of vertical movement of the panels is controlled and limited by the use of breaker switches (not shown), each provided with a lever which, when activated, interrupts the electrical circuit supplying energy to the motor 20, thus stopping the motor 20. The switches, one for the downward movement and one for the upward movement, are attached in an adjustable manner to the fulcrum rest 29 nearest the motor and the levers are positioned such as to be activated by the movement of the cradle base panel 15 and the horizontal beam 17.

Figure 5:
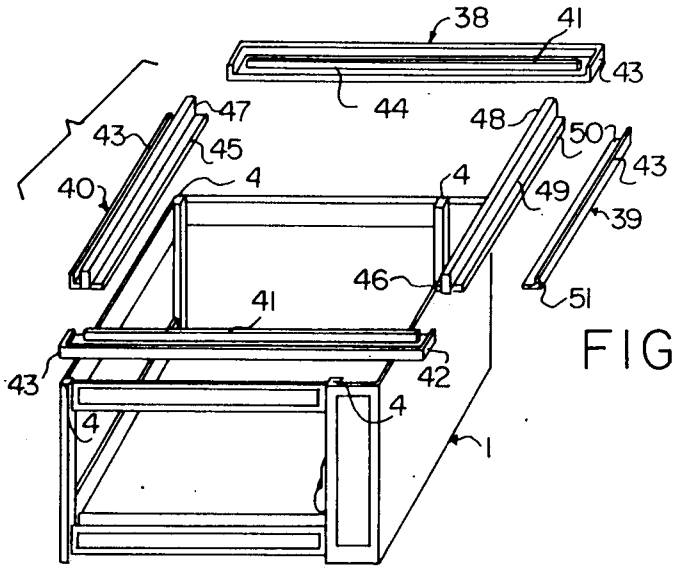
FIG. 5 shows an exploded, perspective view of the canopy border and the vertical canopy supporting members.

FIG. 5 shows how the outside border of the canopy 2 is constructed. The left end outside border 38 member of the canopy 2 is constructed of a vertical support 41 which helps to prevent warpage and provides means for attaching other outside border members by using wood screws, a vertical lip 43 and a horizontal wood board 44. The right end outside border 42 is constructed the same way with a vertical support, an outside lip and a horizontal wood board. The footboard end of the outside border 40 has an outside lip 43 and a horizontal board member 45 and a large vertical support beam 47, which is 2×4 size, and provides support for the canopy 2. The headboard panel support beam 50 differs from the other parts of the border in that it has no lip. It is constructed using a horizontal board 49 and a vertical beam support 48 of the 2×4 size. This 2×4 type beam is necessary to support the weight of the canopy 2. The headboard outside border 39 is constructed with an outside lip 43 and a horizontal board 51. The ends of the vertical support beams 47 and 48 rest on the vertical supports 4 to provide a stable base to sustain the weight of the canopy 2 and horizontal panels and lift mechanism.

The outside border is secured by the use of wood screws which attach the ends of the vertical support beams 47 and 48 to the vertical supports 41 of the left end of the outside border 38 and the right end of the outside border 42. The ends of the vertical support beams 47 and 48 are secured in position over the vertical supports 4 by the use of wooden dowels secured in the ends of the vertical supports 4 and inserted into holes in the ends of the vertical support beams 47 and 48. The headboard end of the outside border 39 is secured by the use of wooden dowels, two on each end, which insert into holes on the inside of the horizontal boards of the right and left ends of the outside border 38 and 42.

Figure 6:
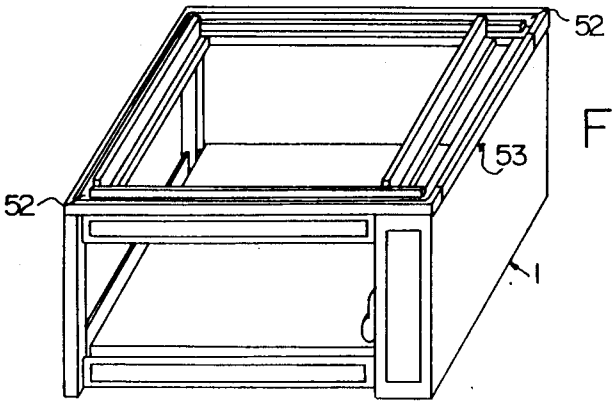
FIG. 6 shows a perspective view of the canopy border installed on the vertical canopy supporting members.

FIG. 6 shows the assembled outside border 53 resting on the bed 1. The constructed border provides a trough 52 in which the vertical panels and corner sections of the canopy rest.

Figure 7:
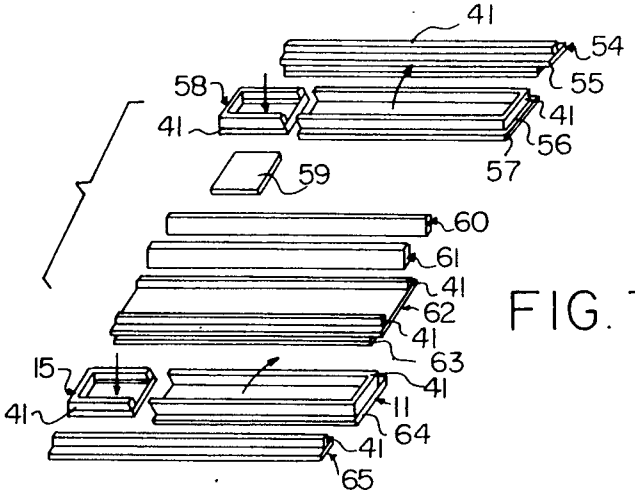
FIG. 7 shows a perspective view of the horizontal panelling system according to the present invention, which is provided inside the canopy border.

FIG. 7 shows different sections of the horizontal paneling 54, 56, 62, 11, 65, 15 and 58, vertical support beams 60 and 61, and a support plate 59. The panels 54, 56, 62, 11, 65, 15 and 58 are constructed using a horizontal panel section and vertical supports 41 to prevent warping. The end panels 54 and 65 also have a flange 55 similar to that seen on the left end panel 54 on the edge adjacent to the horizontal lift panels 56 and 11, upon which the horizontal lift panels 56, 11 passively rest when not in a lifted position. The middle horizontal panel 62 also has the like flanges 63 on both sides adjacent to the horizontal lift panels 56 and 11 upon which the lift panels 56 and 11 rest passively when not in a lifted position. The ends of the panels rest on the footboard end of the outside border 40 (FIG. 5) on the inside 45 of the vertical support beam 47, the other end of the panels resting passively on the headboard panel support beam 50 on the footboard side 46 of the vertical support beam 48.

The flanges allow the right horizontal lift panel 11 and the left horizontal lift panel 56, which are hinged at the headboard end 57, 64, to pivot upwardly, but prevent them from pivoting downwardly past the horizontal position. The cradle base panels 58, 15 are narrow enough to pass between the flanges on either side to move downwardly. There are five horizontal panels, two end panels 54, 65, one on each side, with flanges adjacent to the two horizontal lift panels 56, 11, and one middle horizontal panel 62 with flanges on either side adjacent to the horizontal lift panels 11, 56.

Figure 8:
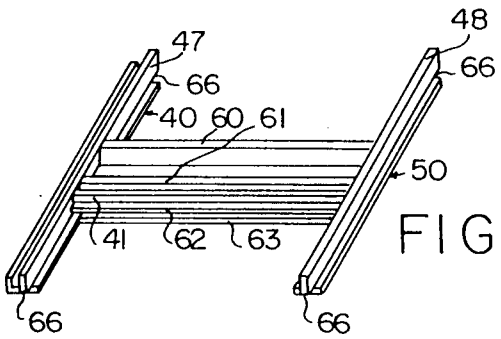
FIG. 8 shows a perspective view of the supporting members for the horizontal panels of the canopy and the two vertical beams upon which the base plate support for the scissors jack lift mechanism rests.

FIG. 8 shows the middle horizontal panel 62 resting passively on the horizontal boards of the footboard end of the outside border 40 and the headboard panel support beam 50. Two vertical beams 60, 61 are attached at either end with bolts to the two vertical beams 47, 48 on the footboard end of the border 40 and the headboard panel support beam 50. The vertical beams 60, 61 are placed just inside the vertical supports 41 on the middle horizontal panel 62 (FIG. 7). A support plate 59 (FIG. 7) is attached to the two vertical beams 60, 61 at their junction with the vertical beam 47 on the footboard end of the outside border of the canopy. This support plate 59 (FIG. 7) serves to support the base plate 34 of the scissors jack 33 (FIG. 4). The vertical beam 47, 48 on the headboard panel support beam 50 and the footboard end of the outside border of the canopy 40 are supported on the ends by vertical supports 4 (FIG. 5).

Figure 9A:
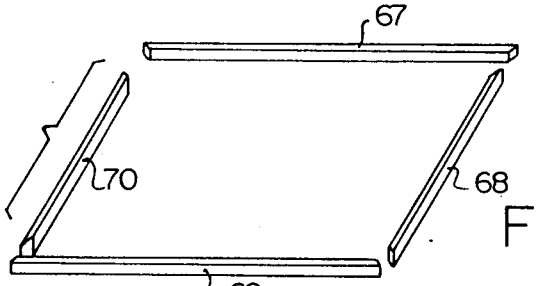
FIG. 9A shows an exploded view of the canopy crown.
Figure 9B:
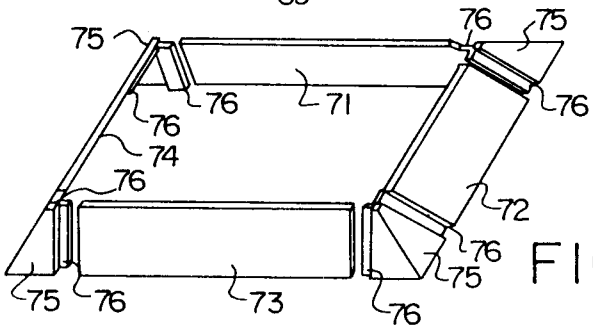
FIG. 9B shows an exploded view of the vertical panels in the canopy and the vertical corner sections to which the panels are attached.

FIG. 9A shows an exploded view of the canopy 2 (FIG. 1) crown. When the sides 67, 68, 69, 70 are attached at the ends, the resulting rectangular structure rests at the top of the canopy 2 (FIG. 1), held in position by wooden dowels. FIG. 9B shows an exploded view of the vertical panels of the canopy 71, 72, 73 74, which are secured to the vertical corner sections 75 of the canopy by overlapping the flanges 76 on the end of the vertical panels 71, 72, 73, 74 of the canopy to the flanges 76 on the vertical corner sections of the canopy 75 with wood screws.

Figure 9C:
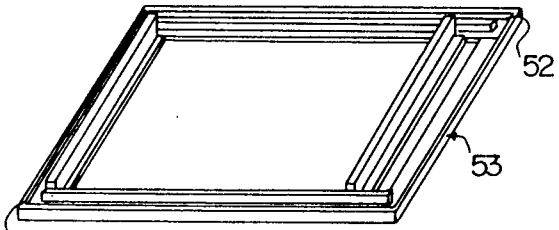
FIG. 9C shows the canopy border and its relative position with respect to the vertical panels and vertical corner sections of the canopy and the canopy crown.

The constructed vertical portion of the canopy rests passively in the trough 52 (FIG. 9C) of the outside border of the canopy 2.

Figure 10:
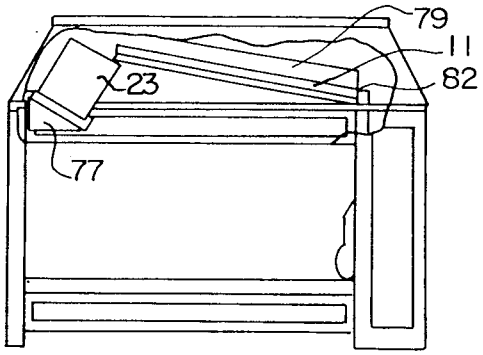
FIG. 10 shows a cut-away view of the canopy bed similar to that shown in FIG. 2 with a second embodiment of the TV supporting means according to the present invention.

FIG. 10 shows another embodiment of the present invention where a television set 23 is positioned on a fixed cradle base panel 77 with a fixed horizontal lift panel 11 positioned to expose the TV screen for convenient viewing, without a mechanized panel system to conceal the television 23, when it is not in use. Blinds 79 attached to the vertical supports 41 (FIG. 7) of the horizontal panels on either side of the horizontal lift panel 11 would create an aesthetic appearance. The horizontal lift panel 11 pivots on a hinge at the headboard end with the other end resting passively on the top of the television set 23.

Figure 11:
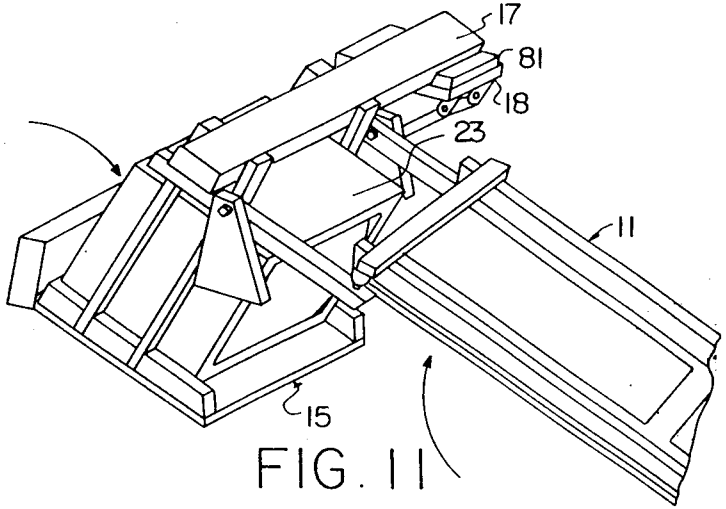
FIG. 11 shows a partial, perspective view of a third embodiment of the present invention with means for pivotally supporting a TV set.

FIG. 11 shows an alternative embodiment of means for concealing the television 23 when not in use. In this embodiment of the present invention, both the cradle base panel 15 and the horizontal lift panel 11 pivot in opposite directions with both panels being secured to vertical beams by hinges. The lift mechanism shown in FIG. 3 which lifts the horizontal lift panel 11 as the cradle base 15 descends would function in the same way. The cradle is constructed to allow the cradle base plate 15 to pivot on a hinged axis. This embodiment of the invention is especially advantageous if a single television set were utilized. When two television sets are used, they may be balanced on the lift mechanism. When a single one is used, it must be mechanically restrained. A stop 81 is added to the scissors jack lift plate 18 to prevent the horizontal beam 17 from slipping off the plate 18.

Figure 12:
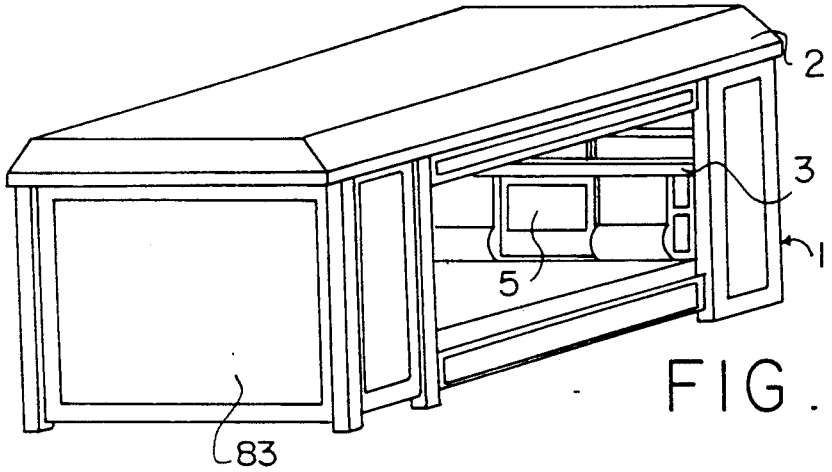
FIG. 12 shows a perspective view of another embodiment of the present invention with a bed frame including a cabinet-type footboard for mounting a TV set therein.

FIG. 12 shows a perspective view of another embodiment of the present invention. A bed 1 has a cabinet type footboard 83 for housing the TV set, and a headboard 3. The cabinet door 5 is also provided on the headboard 3. This embodiment of the present invention allows the overall height of the bed 1 to be reduced while the placement of the television in a cabinet type footboard 83 meets the objectives of the present invention. This embodiment of the present invention would be applicable when utilized in areas where the height of the ceiling is confined by more important construction considerations such as in yacht construction. This embodiment may be constructed without a canopy.

Figure 13:
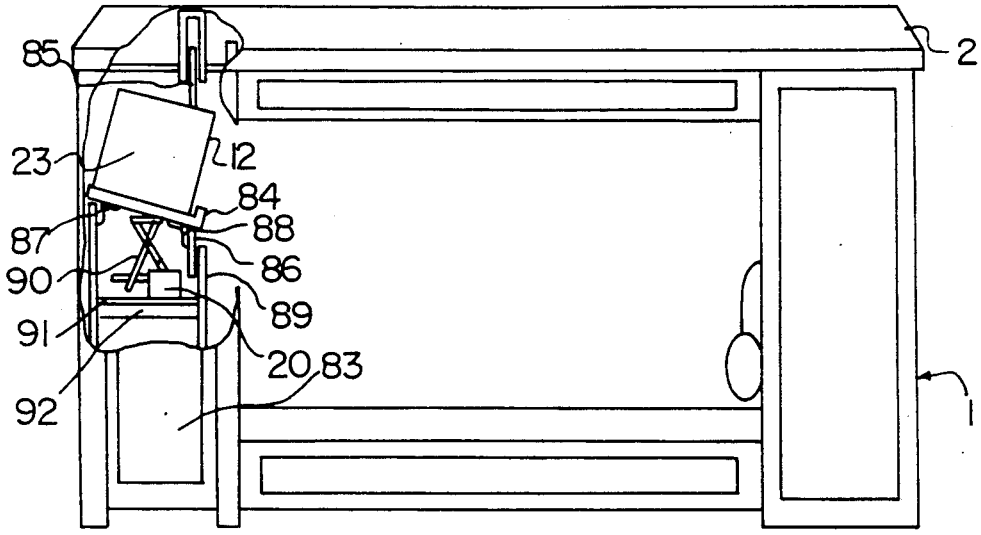
FIG. 13 shows a cut-away, partial, detailed view of the embodiment shown in FIG. 12, illustrating the construction of means for adjusting the viewing angle.

FIG. 13 in more detail the embodiment with a cabinet-type footboard 83 which houses the television set 23 resting in an adjustable cradle base 84 is hinged at hinge 87 at the end farthest from the viewing screen 12. Floating panels 85 and 86 conceal the mechanism for an aesthetic effect when viewed by a reclining viewer. The floating panel 86 below the cradle base 84 is hinged 88 at the top below the cradle base 84. This panel is positioned inside the footboard cabinet panel 89. A reversing electric motor 20 is activated by a three-way electrical switch located conveniently on the headboard 3 (FIG. 12). The motor 20 elevates and lowers the lift mechanism 90 upon which the cradle base 84 rides. The motor 20 and the lift mechanism 90 rest on a base 91 reinforced by vertical supports 92. The panel members on the sides of the television set 23 are closely approximated to the sides of the television set to conceal the mechanism 90 and provide an aesthetic effect for the reclining viewer.

Although the principles of the present invention have been described with reference to a particular embodiment, by way of example, it is understood that modifications may suggest themselves to those skilled in the art and it is intended that such modifications fall within the scope of the claims.

I claim:

1. A combination of a bed with a TV set, comprising:

a bed frame structure including a headboard member, side board members, a footboard member and a canopy member supported by vertical members;

a supporting means provided within said frame structure for supporting a TV set thereon;

means for positioning said TV set for unobstructed viewing by a person while reclining in the bed;

means for at least partially concealing said TV set within said canopy member when said TV set is not in use;

wherein said supporting means includes a first movable panel supporting said TV set and defining a portion of a bottom wall of said canopy member and said means for positioning includes a lifting mechanism for upward and downward movement of said panel between a first position wherein said TV set is concealed inside said canopy and a second position wherein said TV set is exposed for convenient viewing by a person reclining on a bed.

2. A combination according to claim 1, wherein said first movable panel is pivotable between said first and second positions.

3. A combination according to claim 1, wherein said first movable panel is movable in a substantially vertical direction.

4. A combination according to claim 3, wherein said bottom wall of said canopy member further includes a second movable panel which is activable by means associated with said first panel, said second panel being adapted to move in a direction opposite to said first panel.

5. A combination according to claim 1, wherein said bottom wall of said canopy member further includes a second movable panel which defines part at said means for concealing and is activatable by means associated with said first panel which also defines a part of said means for, said second panel being adapted to move in a direction opposite to said first panel.

6. A combination according to claim 5, wherein adjacent ends of said first and second panel contacting each other are aligned to form a continuous plane of said bottom wall of said canopy member.

7. A combination according to claim 6, wherein said second panel is pivotable about a hinge at a second end opposite to said contacting end of said second panel.

8. A combination of a bed with a TV set, comprising:

a bed frame structure including a headboard member, side board members, a footboard member and a canopy member supported by vertical members;

a supporting means provided within said frame structure for supporting at least one TV set thereon;

means for positioning said TV set for unobstructed viewing by a person while reclining in the bed;

means for at least partially concealing said TV set within said canopy member when said TV set is not in use;

said supporting means includes a first movable panel supporting said TV set and said means for positioning includes means for moving said panel between a first position wherein said TV set is substantially concealed inside said canopy and a second position wherein said TV set is exposed for convenient viewing by a person reclining on a bed.

9. A combination according to claim 8, wherein said first movable panel is pivotable between said first and second positions.

10. A combination of a bed with means for supporting a TV set, comprising:

a bed frame structure including a canopy member supported by vertical members;

a supporting means providing within said canopy member for supporting a bottom of at least one set positioned thereon and for positioning of said TV set for unobstructed viewing by a person while reclining in the bed;

means for at least partially concealing said TV set within said canopy, said means including a panel mounted in said canopy, said panel being adapted to pivot about its one end and at its free end to rest on the top of said TV set.

11. A combination according to claim 10, wherein said bed frame structure includes a headboard member, said board members and a footboard member.

* * * * *